United States Patent [19]

Galis

[11] 4,456,405

[45] Jun. 26, 1984

[54] MINE ROOF TRUSS ASSEMBLY AND ASSOCIATED METHOD

[76] Inventor: Alex Galis, c/o Julia Tobias, P.O. Box 227, Hiller, Pa. 15444

[21] Appl. No.: 449,161

[22] Filed: Dec. 13, 1982

[51] Int. Cl.[3] ..... E21D 11/00; E21D 21/00

[52] U.S. Cl. ..... 405/288; 405/259

[58] Field of Search ..... 405/259, 260, 261, 288, 405/290; 299/11; 52/226, 227

[56] References Cited

U.S. PATENT DOCUMENTS

| | | | |
|---|---|---|---|
| 793,358 | 6/1905 | Doyle | 52/226 X |
| 2,192,554 | 3/1940 | Moisseeff-Muspratt | 405/288 |
| 2,667,037 | 8/1949 | Thomas et al. | 405/260 |
| 2,813,310 | 11/1957 | Harrison | 52/226 |
| 2,856,644 | 10/1958 | Dunham | 52/226 |
| 3,139,730 | 7/1964 | Williams et al. | 405/259 |
| 3,341,995 | 9/1967 | Docken | 52/226 |
| 3,427,773 | 2/1967 | Kandall | 52/225 |
| 3,427,811 | 3/1967 | White | 405/259 |
| 3,505,824 | 4/1970 | White | 405/259 |
| 3,509,726 | 6/1970 | White | 405/259 |
| 3,601,994 | 8/1971 | Galis | 405/259 |
| 3,913,338 | 10/1975 | Galis | 405/259 |
| 4,052,860 | 10/1977 | Alterman | 405/259 |
| 4,265,571 | 5/1981 | Scott | 405/259 |
| 4,274,762 | 6/1981 | Johnson | 405/259 |
| 4,349,300 | 8/1980 | Kelley | 405/288 |

FOREIGN PATENT DOCUMENTS

| | | | |
|---|---|---|---|
| 2037172 | 2/1972 | Fed. Rep. of Germany | 405/259 |
| 273887 | 6/1951 | Switzerland | 52/226 |

*Primary Examiner*—Dennis L. Taylor

*Attorney, Agent, or Firm*—Buell, Blenko, Ziesenheim & Beck

[57] ABSTRACT

A mine roof truss assembly includes a mine roof, an underlying elongated support member, an elongated tension member secured in underlying relationship with respect to the support member, roof bolts passing angularly upwardly and outwardly through the tension member and support member. The tension member being flexible and being maintained in tension through other components of the assembly. Roof plate members and cooperating washers having upwardly convex portions may cooperate with the roof bolts, the tension member and support member in maintaining the integrity of the assembly. A method of supporting a mine roof comprising providing the above described components with the support member having end portions which are hingedly attached to the remaining body portion of the support member. Initiating securement of the assembly with the pivoted end portions being generally downwardly and outwardly oriented and rotating upwardly under influence of the roof bolts as they enter the mine roof holes thereby causing the support member to assume a generally planar orientation with the tension member in tension.

19 Claims, 15 Drawing Figures

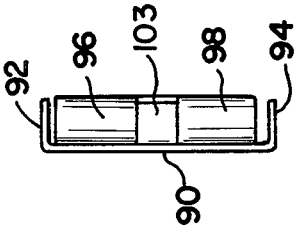
FIG. 12
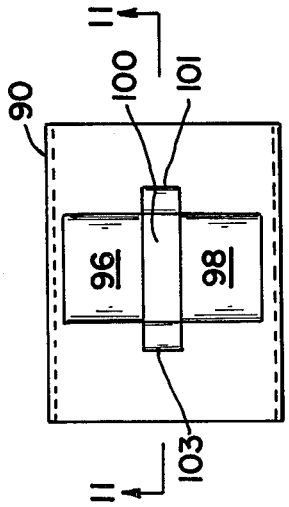
FIG. 10
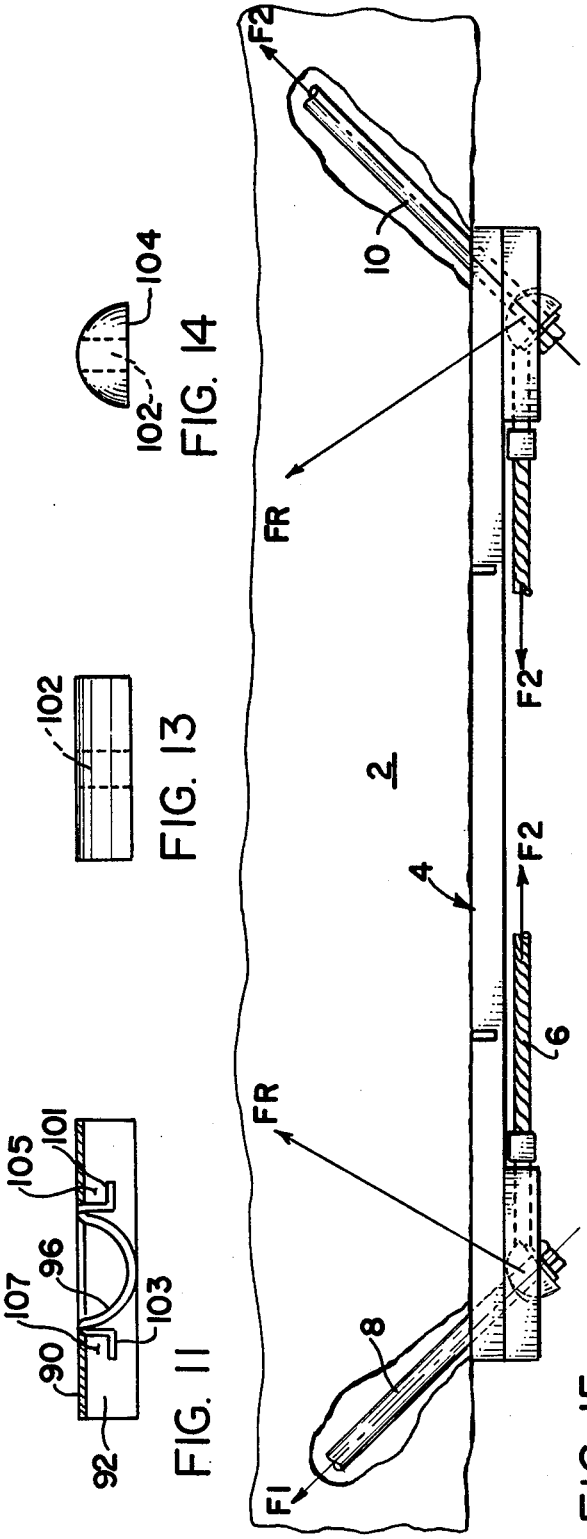
FIG. 14
FIG. 13
FIG. 11
FIG. 15

MINE ROOF TRUSS ASSEMBLY AND ASSOCIATED METHOD

BACKGROUND OF THE INVENTION

1. Field of the Invention

This invention relates to mine roof truss assemblies and a method of establishing the same and, more specifically, it relates to an improved assembly which employs a combination of an anchored elongated support member with a flexible underlying tension member.

2. Description of the Prior Art

In connection with underground mining operations it has been known to provide various means of roof support so as to resist potentially hazardous mine cave-ins. Among the known systems are those which use truss members which are anchored to the mine roof in the passageway areas so as to provide mechanical support for the overlying roof strata.

It has previously been known to support a mine roof by securing timbers or steel crossbeams to the roof by means of expansion bolts which are oriented generally upwardly and outwardly with respect to the centerline of the line passageway. See U.S. Pat. No. 2,667,037.

It has also been known to employ angularly upwardly and outwardly oriented mine roof holes wherein a flexible cable member has its ends anchored as a result of being wrapped around a wedge member which has been forced into the hole. See U.S. Pat. No. 3,601,994. In this patent, one embodiment has longitudinally oriented timbers disposed between the cable and the mine roof.

It has also been known to provide angularly upwardly and outwardly anchored roof bolts to which are secured cable members which are tensioned by means of a turnbuckle. See U.S. Pat. No. 3,427,811.

While these prior art systems have offered certain advantages, there remains a need for an efficient roof truss system which is economical to employ, may be rapidly installed and provides effective safe conditions in a potentially hazardous area.

SUMMARY OF THE INVENTION

The present invention has met the above-described need by providing an improved mine roof truss assembly and the method of assembling the same. An elongated support member is disposed in underlying relationship with the roof and preferably has a pair of hingedly secured end portions with preformed openings through which roof bolts may pass. An elongated, flexible tension member is secured in underlying relationship with respect to the support member and roof bolts are passed through portions of the tension member and portions of the support member. The roof bolts are anchored in generally upward and outward orientation with respect to the mine passageway. A mine roof plate and an associated washer having an upwardly convex surface may be positioned in underlying relationship to the support member.

In creating the assembly of the present invention the hinged end portions of the support member may be initially oriented generally downwardly and outwardly. Roof bolt members are passed through the washer, roof plate, securing means, such as an eyelet of the tension member and the openings in the support member. Driving the roof bolts into the mine roof holes results in generally upward rotation of the hinged support member end portions and tensioning of the tension member. In the final position, the support member may be generally planar in orientation as compared with the initial configuration.

It is an object of the present invention to produce a prefabricated mine roof truss assembly which is economical to manufacture and use and yet provides effective securement of the mine roof.

It is another object of the present invention to provide a method for efficiently, economically and rapidly establishing such a mine roof truss assembly.

It is another object of the present invention to provide such a construction wherein force distributions are so controlled as to provide substantial resistance to undesired roof collapse.

It is yet another object of the present invention to provide a truss system which does not require excess space above the truss members and as a result does not require spacer beams to be inserted between the upper portion of the truss member and the roof.

These and other objects of the invention will be more fully understood from the following description of the invention on reference to the illustrations appended hereto.

BRIEF DESCRIPTION OF THE DRAWINGS

FIG. 10 is a bottom plan view of a form of mine roof plate employed with the present invention.

FIG. 11 is a cross sectional illustration of the mine roof plate of FIG. 10 taken through 11—11.

FIG. 12 is an end elevational view of the mine roof plate of FIG. 10.

FIG. 13 is a bottom plan view of a form of washer employed in the present invention.

FIG. 14 is an elevational view of the washer of FIG. 13.

FIG. 15 is a fragmentary, partially schematic view of a form of assembly of the present invention showing force components.

DESCRIPTION OF THE PREFERRED EMBODIMENTS

As used herein the term "upwardly" shall refer to a direction with respect to a mine passageway which is oriented generally along the direction extending from the mine floor to the mine roof or therebeyond. As used herein the term "outwardly" shall refer to an orientation generally in tranverse direction extending from the mine passageway central longitudinal axis to the walls of the passageway. These orientations shall be deemed reference axes and shall be considered as extending beyond the floor, roof and walls of the passageway.

Figure 1:
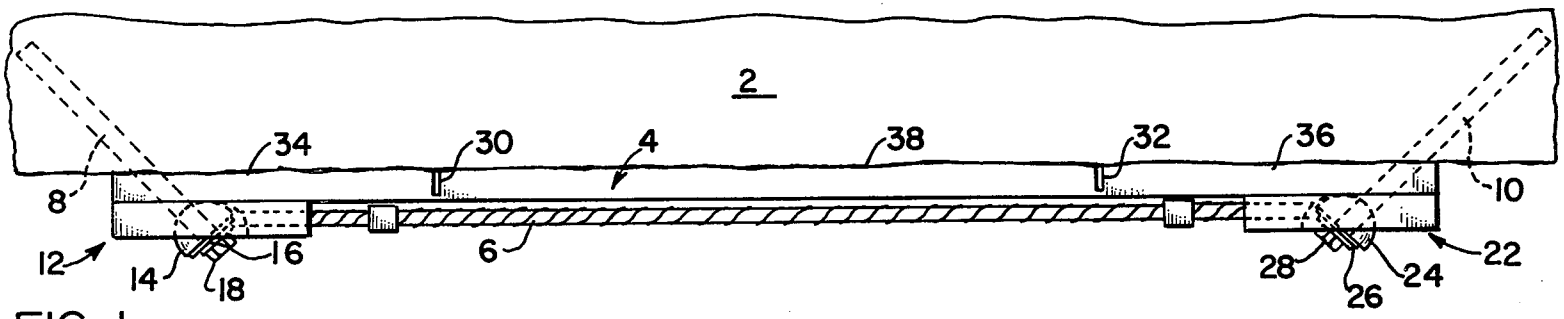
FIG. 1 is a partially schematic vertical elevational view of a form of mine roof truss assembly of the present invention.

Referring now more specifically to FIG. 1 there is shown a mine roof 2. An elongated support member 4 is disposed in underlying relationship with respect to the roof 2 and, in the form shown, is contacting the roof. Underlying the support member 4 is an elongated tension member 6 which may advantageously consist of a wire rope, cable or wire strand, for example. A pair of roof bolts 8, 10 are each secured to the roof and are oriented generally upwardly and outwardly. Roof bolt 8 passes through mine roof plate 12, generally upwardly convex domed washer 14, flat washer 16 and has bolt head 18 at its lower extremity in order to assist with applying the desired torque to the roof bolt. Similarly, roof bolt 10 passes through mine roof plate 22, upwardly convex domed washer 24, flat washer 26 and has bolt head 28 at the lower end thereof. The flat washers 16, 26 serve to reduce friction and permit more accurate torquing of the bolts.

Elongated support member 4 may preferably be made of formed sheet metal and have a pair of cuts 30, 32 which extend through a substantial portion of the height of support member 4 but leave a portion of the member intact. This serves to create two hinge regions at cuts 30, 32 which permit end portions 34, 36 to be rotated generally downwardly with respect to central body portions 38 in a fashion which will be described hereinafter. The included angle A, B (FIG. 6) between the end portions 34, 36 and the roof 2 may initially be preferably about 40 to 60 degrees. In use the end portions are rotated upwardly until they are generally aligned with the body portion 38 to form a generally straight configuration.

Figure 2:
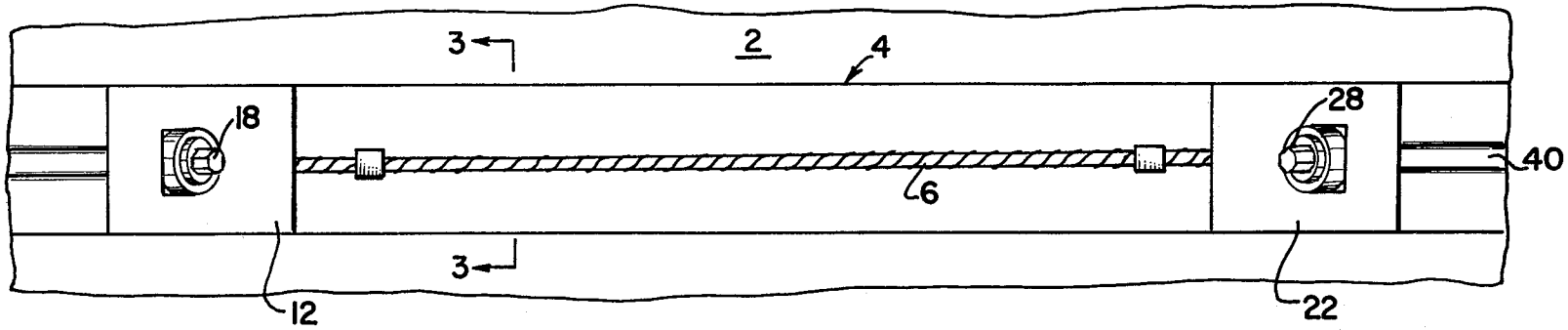
FIG. 2 is a bottom plan view of the form of assembly shown in FIG. 1.
Figure 3:
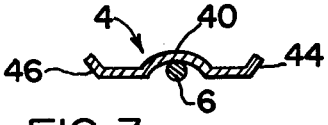
FIG. 3 is a cross sectional illustration of the assembly of FIG. 2 taken through 3—3 of FIG. 2 (with portions of the assembly deleted for clarity).

Referring to FIGS. 2 and 3, there is shown the undersurface of a portion of the assembly. The support member 4, in the form shown, has an upwardly projecting, downwardly open longitudinal rib 40 which is adapted to at least partially receive the tension member 6 thereby minimizing the downward projection of the assembly into the underlying passageway. As is shown in FIG. 3, the support member 4 is preferably made out of formed sheet metal which may, for example, be galvanized steel which may be of substantially uniform cross sectional configuration throughout its longitudinal extent and may advantageously be made by roll forming. In addition to the downwardly open generally central rib 40, which at least partially receives tension member 6, the support member has a pair of lateral generally upwardly projecting flanges 44, 46 which may be placed in contact with the roof surface.

The tension member 6 may advantageously be metal. It may, for example consist of a length of 3×19 coreless slusher rope with a breaking strain of about 21,400 pounds, for example, and a yield strength of about 16,200 pounds, for example. The length of the tension member 6 should be such that when the roof bolts are torqued into final position and the support member placed in substantially flat orientation, the rope will be tensioned to about 5,000 to 7,000 pounds.

Figure 4:
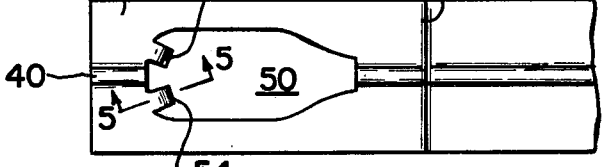
FIG. 4 is a portion of the underside of the support member of the present invention.
Figure 5:
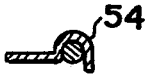
FIG. 5 is a cross sectional illustration of a portion of the support member of FIG. 4 taken through 5—5.
Figure 6:
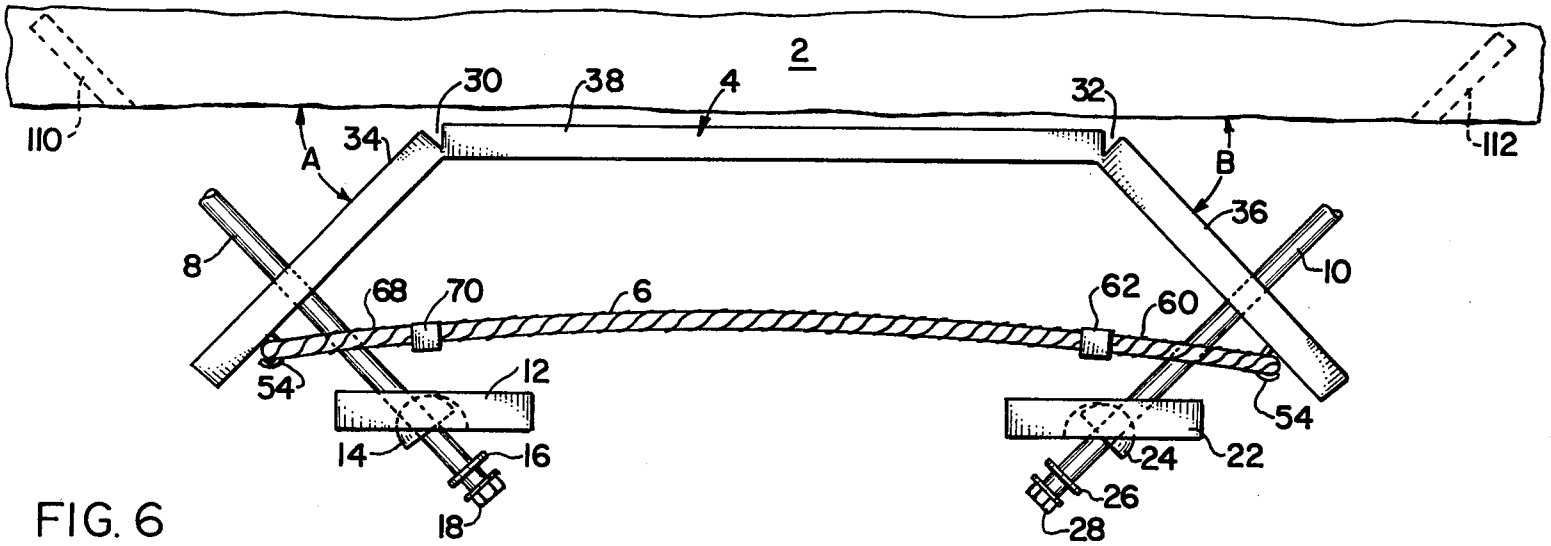
FIG. 6 is a fragmentary illustration of a portion of the assembly of the present invention shown prior to completion of assembly.
Figure 9:
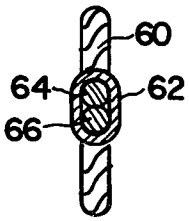
FIG. 9 is a cross sectional illustration taken through 9—9 of the tension member of FIG. 8.
Figure 8:
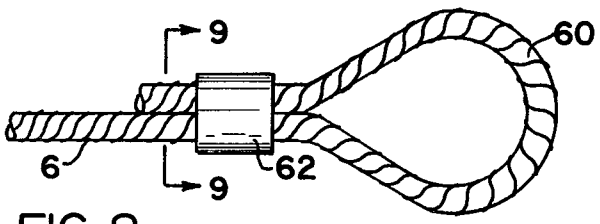
FIG. 8 is a fragmentary illustration of a form of securing means of a tension member of the present invention.

Referring now to FIGS. 4 and 5 further details of the support member 4 will be considered. In a preferred embodiment, each end portion 34, 36 will be provided with a preformed opening 50 through which the roof bolt may pass and with respect to which the tension member 6 may be secured. For purpose of securing the tension member 6 to ends 34, 36, a pair of generally hook-shaped tabs 52, 54 are provided. As is shown in FIGS. 6, 8 and 9 each end of the tension member 6 preferably terminates in a loop 60 which is maintained by a circumferential clip member 62 which, as is shown in FIG. 9, supports the two strands 64, 66 of the loop defining end of the tension member 6. The clip 62 may be secured by any desired means as by welding or crimping, for example. As is shown in FIG. 6, loop 60 is secured to tabs 52, 54 (not shown in this view) of end portion 36 and loop 68 is secured by clip 70 and is attached to end 34 of support member 4 by tabs 52 (not shown) and 54.

Figure 7:
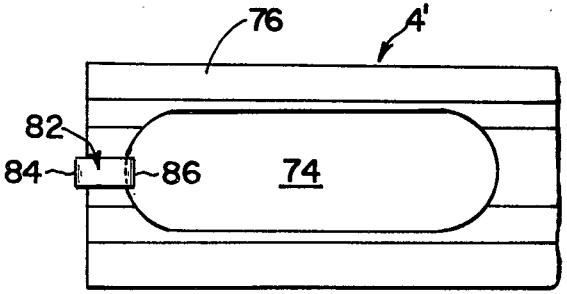
FIG. 7 is a fragmentary illustration of a portion of the support member of the present invention.

FIG. 7 shows a modified form of opening 74 in end portion 76 of support member 4'. Another feature shown in FIG. 7 is the use of one or more clip members 82 in lieu of or in addition to tabs 52, 54. Clip member 82 has a generally sheet-like elongated body with a downwardly depending right angular flange adapted to engage the exterior of support member 4'. The other end has a downwardly depending flange 86 which is generally hook shaped with the hook opening in the position shown facing the left in FIG. 7. The flange 86 is adapted to engage loop 68.

Referring once again to FIGS. 10 through 12, a preferred form of roof plate will be considered. The plate, which preferably is composed of substantially rigid material, such as steel, has a body 90 and a pair of generally parallel flanges 92, 94. A pair of projecting strap members 96, 98 project in the same direction as the flange. In use, the ends of flanges 92, 94 will contact the support member and the roof bolt will pass through gap 100 defined between straps 96, 98. A generally upwardly domed, upwardly convex washer member, such as that illustrated in FIGS. 13 and 14 will be received within the recess defined by straps 96, 98 and have an opening 102 through which the roof bolt will pass. The convex portion of the domed washer has a complementary configuration with respect to the straps and recess defined in the roof plates 12, 22. It will be appreciated that in position, surface 104 of the washer will be generally flush with body portion 90. It will be further appreciated that with the roof bolt in position the bolt in cooperation with the domed washer will engage the restraining means such as loops 60, 68 in the tension member and thereby transmit tension thereto. Also, the loops will be retained by plate tabs 101, 103 in recesses 105, 107, respectively.

Referring once again to FIG. 6, the method of the present invention will be discussed in greater detail. In practicing the method of the present invention the support member is positioned against the roof by jacks or other suitable means. Using the openings in the downwardly angularly disposed ends 34, 36 as guides, a pair of angularly upwardly and outwardly directed holes 110, 112 for receipt of the roof bolts 8, 10, respectively, are drilled. With the support member 4 positioned closely adjacent to the roof and the end portions 34, 36 pivoted so as to be oriented generally downwardly and outwardly, the tension member 6 is secured to the end portions 34, 36 by means of clips 52, 54 and tabs 101, 103. Roof bolt 8 is passed through flat washer 16, domed washer 14, eyelet 68, the preformed opening in end portion 34 and extends into hole 110. Similarly, roof bolt 10 passes through flat washer 26, domed washer 24, roof plate 22, eyelet 60, the opening in end portion 36 and enters hole 112. By suitably advancing the roof bolts 8, 10 into the respective holes 110, 112 and applying torque to bolt heads 18, 28 the assembly will be advanced with the end portion 34, 36 rotating generally upwardly about their hinge portions defined by cuts 30, 32. This ultimately results in the support member 4 having the configuration illustrated in FIG. 1 with tension being applied to the tension member 6. It will be appreciated that the tension member is secured to the support member 4, the roof plates 12, 22 and the roof bolts 8, 10.

As is shown in FIG. 15, the roof bolts 8, 10 have force components F1 and F2 which are forces opposed to the tension applied to the tension member 6. These will generally be substantially equal, but this is not essential. The forces FR—indicate the resultant forces acting on the roof tending to support the same. The magnitude and direction of FR may vary depending on the magnitudes of F1 and F2.

It will also be appreciated that by use of a flexible tension member there is eliminated the need for precise spacing of roof bolt holes 110, 112 and the need for high precision tolerance in creating the length of the tension member.

It will be appreciated that the present invention provides an efficient, economical and rapidly created mine roof truss assembly. In addition, it provides effective roof control, while not requiring spacers between the truss and the roof.

It will be appreciated that once the assembly is completed the roof bolts and tension member form a continuous member from anchor to anchor.

It will be appreciated that while certain preferred embodiments of the invention have been illustrated, variations in the same may be provided while obtaining many if not all of the benefits of the invention. For example, while the domed washer 14 has been illustrated as being composed of solid metal material, it may advantageously be formed from sheet metal having an opening for passage of a roof bolt therethrough, and defining a flat lower portion for engagement with the sheet washer 16.

While a preferred form of the support member 4 involves a ribbed unitary structure having a pair of integrally hinged end portions and a generally uniform profile throughout its longitudinal extent this is not essential. For example, the member 4 may be formed from separate pieces which are joined by suitable means such as mechanical fasteners or welding, for example, one efficient means of providing members 4 of different length would be to provide end portions 34, 36 as separate members and secure them to a body portion 38 of a desired length. Alternatively, the end portions may be unitary with a portion of the body portion and be joined to the remainder of the body portion. Also, if desired, the end portions 34, 36 may be secured to the body portion by separate as opposed to integral hinges. In addition, portions of the member 4 may have a different profile from other portions, if desired.

Whereas particular embodiments of the invention have been described for purposes of illustration it will be evident that numerous variations of the details may be made without departing from the invention as defined in the appended claims.

I claim:

1. A mine roof truss assembly comprising a mine roof, an elongated support member underlying said mine roof, an elongated tension member secured in underlying relationship with respect to said support member, roof bolt means passing through said elongated support member and into said mine roof, said tension member operatively associated with said roof bolt means and said support member, said roof bolt means including a pair of roof bolts passing through said elongated support member generally adjacent to the longitudinal ends of said support member, said tension means being a flexible member, and said elongated support member having a central body portion and a pair of end portions which are rotatable with respect to said central portion, whereby securement of said assembly by advancing said roof bolts will cause upward rotation of said end portions and tensioning of said tension means.

2. The mine roof truss assembly of claim 1 including said roof bolts extending upwardly and angularly outwardly into said mine roof, and said roof bolts assuming a generally upwardly diverging relative relationship.

3. The mine roof truss assembly of claim 2 including said tension member being a wire rope.

4. The mine roof truss assembly of claim 3 including said support member being a sheet metal member in section having at least a portion provided with a pair of outwardly projecting lateral flanges and an upwardly projecting, downwardly open rib member.

5. The mine roof truss assembly of claim 3 including said roof bolts passing through preformed openings in said support member, and said support member having hinge means disposed between said openings and the center of said support member.

6. The mine roof truss assembly of claim 5 including roof plate members interposed between said support member and the head of said roof bolt.

7. The mine roof truss assembly of claim 6 including said tension means secured to said support member.

8. The mine roof truss assembly of claim 7 including a washer member having an upwardly convex surface secured to said roof bolt and at least partially received within a recess in said plate member.

9. The mine roof truss assembly of claim 8 including said tension means having a closed loop at each end, and said washers engaged with said closed loops.

10. The mine roof truss assembly of claim 1 including said support member being formed sheet metal.

11. The mine roof truss assembly of claim 10 including said support member being in contact with said mine roof.

12. The mine roof truss assembly of claim 11 including said tension member being a wire rope.

13. The mine roof truss assembly of claim 10 including said support member being of unitary construction.

14. The mine roof truss assembly of claim 10 including said support member being an assembly of at least three pieces.

15. The method of supporting a mine roof comprising providing an elongated support member having a body portion with a pair of end portions hingedly secured thereto, providing an elongated tension member with securing means at opposed ends, providing a pair of roof bolts, positioning said elongated support member in overlying relationship with respect to said tension member and having said end portions generally downwardly and outwardly oriented, establishing a pair of holes in said mine roof in a generally angularly upwardly and outwardly direction, passing said roof bolts through said tension member securing means, through said support member and into said roof holes, and substantially simultaneously with the introduction of said roof bolts into said holes rotating said support member end portions generally upwardly.

16. The method of claim 15 including tensioning said tension means by introducing said roof bolts into said roof holes.

17. The method of claim 16 including said securing means being integrally formed eyelets.

18. The method of claim 17 including positioning a roof plate on said roof bolt underneath said support member.

19. The method of claim 18 including rotating said support member end portions upwardly until said end portions are generally aligned with the remainder of said support member.

* * * * *

UNITED STATES PATENT AND TRADEMARK OFFICE

CERTIFICATE OF CORRECTION

PATENT NO. : 4,456,405

DATED : June 26, 1984

INVENTOR(S) : ALEX GALIS

It is certified that error appears in the above-identified patent and that said Letters Patent is hereby corrected as shown below:

On the Title Page, under "References Cited", the issue date of Kandall 3,427,773 should be --2/1969--.

On the Title Page, under "References Cited", the issue date of White 3,509,726 should be --5/1970--.

Claim 4, column 6, line 26, "outwardly" should be --upwardly--.

Signed and Sealed this

*Thirtieth* Day of *October 1984*

[SEAL]

*Attest:*

GERALD J. MOSSINGHOFF

*Attesting Officer*

*Commissioner of Patents and Trademarks*